US011969663B2

(12) United States Patent
Wong

(10) Patent No.: US 11,969,663 B2
(45) Date of Patent: Apr. 30, 2024

(54) TOY VEHICLE SUSPENSION AND WHEELS

(71) Applicant: Silverlit Limited, Causeway Bay (HK)

(72) Inventor: Kwok Leung Wong, Causeway Bay (HK)

(73) Assignee: SILVERLIT LIMITED, Causeway Bay (HK)

( * ) Notice: Subject to any disclaimer, the term of this patent is extended or adjusted under 35 U.S.C. 154(b) by 338 days.

(21) Appl. No.: 17/504,926

(22) Filed: Oct. 19, 2021

(65) Prior Publication Data

US 2023/0118786 A1 Apr. 20, 2023

(51) Int. Cl.
*A63H 17/26* (2006.01)
*A63H 17/36* (2006.01)
*A63H 29/22* (2006.01)

(52) U.S. Cl.
CPC ..... *A63H 17/262* (2013.01); *A63H 17/36* (2013.01); *A63H 29/22* (2013.01)

(58) Field of Classification Search
CPC ..... A63H 17/00; A63H 17/004; A63H 17/36; A63H 17/38; A63H 29/22
USPC ..... 446/441, 448, 454, 456, 457, 460, 462, 446/465, 466, 468, 469, 470
See application file for complete search history.

(56) References Cited

U.S. PATENT DOCUMENTS 1,323,235 A * 11/1919 Hobson ..... B60B 9/06 152/75
1,509,982 A * 9/1924 Schoeneck ..... B60B 9/26 301/67
3,182,705 A * 5/1965 Markow ..... B60B 9/26 152/12
4,773,889 A * 9/1988 Rosenwinkel ..... A63H 17/262 301/41.1
4,832,098 A * 5/1989 Palinkas ..... B60C 7/107 152/323
5,338,246 A * 8/1994 Suto ..... A63H 17/262 446/466
5,487,692 A * 1/1996 Mowrer ..... A63H 17/262 446/448
6,264,283 B1 * 7/2001 Rehkemper ..... A63H 17/262 301/105.1
8,038,504 B1 * 10/2011 Wong ..... A63H 30/04 446/454
8,631,844 B2 * 1/2014 Anderfaas ..... B60C 19/00 152/80
8,991,455 B2 * 3/2015 Cron ..... B60C 7/107 152/324
9,381,442 B2 * 7/2016 Barse ..... A63H 18/00
9,445,960 B2 * 9/2016 Abughaida ..... A61G 5/061
9,539,876 B2 * 1/2017 Winshtein ..... F16F 1/128
9,969,220 B2 * 5/2018 Toyosawa ..... B60C 7/18
10,011,146 B2 * 7/2018 Fudemoto ..... B60B 9/04
(Continued)

*Primary Examiner* — Joseph B Baldori
(74) *Attorney, Agent, or Firm* — Greenberg Traurig, LLP

(57) ABSTRACT

A toy includes a vehicle body having a front portion and a rear portion. A pair of rear wheels is coupled with the rear portion and located on the vehicle so as to at least partially support the rear portion. A first electric motor is drivingly coupled with the at least one rear wheel. There is a pair of front wheels coupled with the front portion and located on the vehicle so as to at least partially support the front portion. The wheels have two sets of 3-dimensional spokes act as a level of shock absorbent freedom of rotation and a freedom of translation thereby to absorb kinetic energy from an impact force.

20 Claims, 20 Drawing Sheets

(56) References Cited

U.S. PATENT DOCUMENTS

| | | | | |
|---|---|---|---|---|
| 10,500,894 | B2 * | 12/2019 | Park | B60B 3/001 |
| 10,525,766 | B2 * | 1/2020 | Daniels | B60B 9/28 |
| 10,696,096 | B2 * | 6/2020 | Van Riper | B60C 7/18 |
| 10,836,211 | B2 * | 11/2020 | Abe | B60B 9/04 |
| 10,850,207 | B2 * | 12/2020 | Tilley | A63B 59/30 |
| 10,953,696 | B2 * | 3/2021 | Thompson | B60C 11/0311 |
| 11,179,969 | B2 * | 11/2021 | Thompson | B60C 11/0311 |
| 11,235,619 | B2 * | 2/2022 | Tsuji | B60C 7/10 |
| 11,241,636 | B2 * | 2/2022 | Vetuskey | A63H 17/262 |
| 11,479,102 | B2 * | 10/2022 | Kossett | B60K 1/02 |
| 2006/0079151 | A1 * | 4/2006 | Suimon | A63H 17/36 446/460 |
| 2008/0261487 | A1 * | 10/2008 | Torres | A63H 17/262 446/448 |
| 2009/0098799 | A1 * | 4/2009 | Leonov | A63H 17/18 446/460 |
| 2009/0294000 | A1 * | 12/2009 | Cron | B60C 7/18 152/5 |
| 2014/0060715 | A1 * | 3/2014 | Winshtein | B60B 9/24 152/5 |
| 2014/0227941 | A1 * | 8/2014 | Suzuki | A63H 17/36 446/456 |
| 2015/0111462 | A1 * | 4/2015 | Barse | B60B 3/005 446/465 |
| 2016/0068016 | A1 * | 3/2016 | Winshtein | B60B 9/24 301/6.5 |
| 2016/0075176 | A1 * | 3/2016 | Solheim | B60B 9/26 29/894.341 |
| 2016/0193877 | A1 * | 7/2016 | Jang | B60B 19/04 152/69 |

* cited by examiner

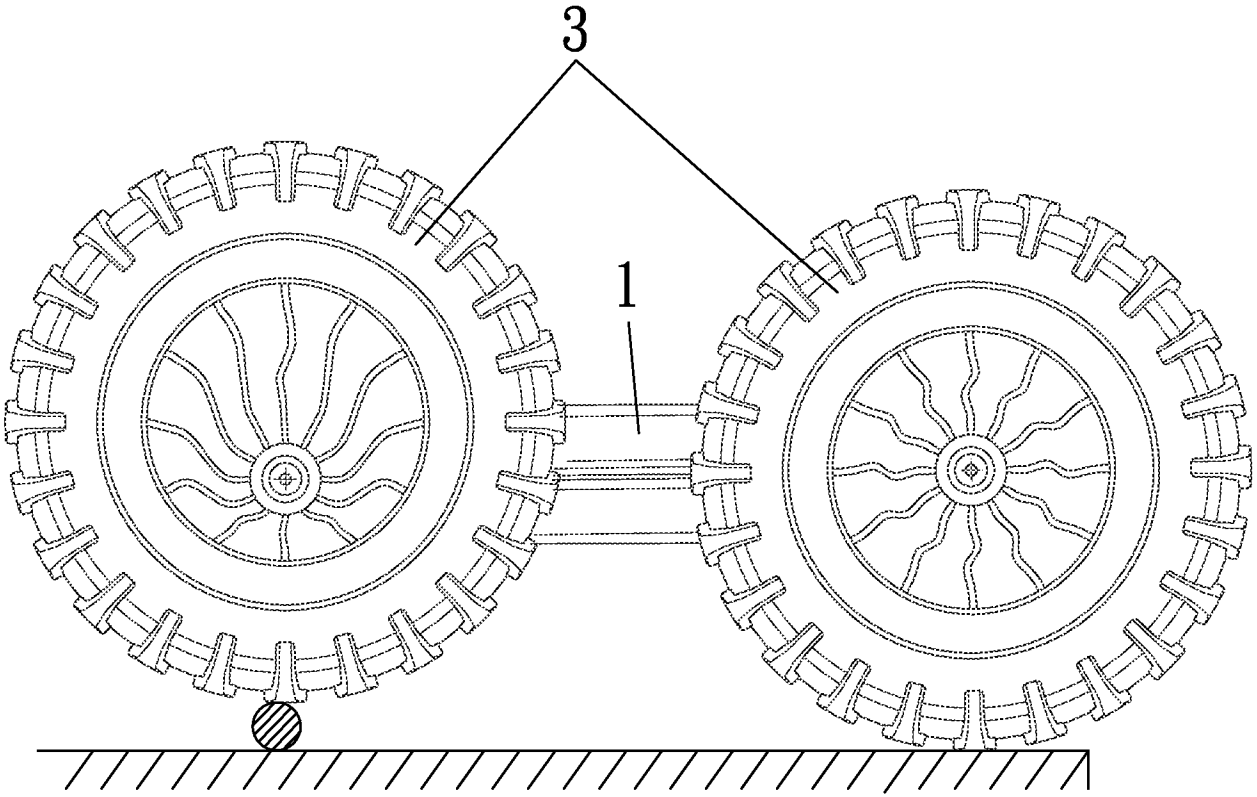
Figbe

TOY VEHICLE SUSPENSION AND WHEELS

FIELD OF THE DISCLOSURE

The present disclosure relates generally to toy vehicles and, more particularly, to remote control toy vehicles.

A variety of toy vehicles such as toy car are known which may be upset or overturned during normal operation. This can be a problem for operation by a user.

In traditional design, a suspension system consists of tires, springs or shock absorbers and linkages that connects a vehicle to its wheels.

Like a real car, the remote control toy cars are usually designed to achieve a good controllability. Sometimes it may be disorientated and result in wheels that do not engage the driving surface in the best manner. This is not convenient for moving and driving the toy.

A toy vehicle design having a system to regulate operation irrespective of the driving surface and would be desirable and would provide enhanced entertainment.

SUMMARY

The present disclosure provides a toy so as to provide easy use to the user.

According to one aspect of the disclosure, a toy vehicle is provided wherein there is a vehicle body having a front portion and a rear portion.

In this disclosure, a suspension system of each wheel is integrated with a respective wheel hub of a toy vehicle. Operation of the toy is easier and more stable than conventional toy vehicles. The power transmission system and mechanical structure can be simplified to facilitate manufacturing.

A pair of rear wheels is coupled with the rear portion and located on the vehicle so as to at least partially support the rear portion. A first electric motor is drivingly coupled with the at least one rear wheel. There is a pair of front wheels coupled with the front portion and located on the vehicle so as to at least partially support the front portion. An electrically operated steering actuator is mounted on the front portion and is drivingly coupled to the at least one front wheel to rotate the front wheels to steer the toy vehicle.

The disclosure is further described with reference to the accompanying drawings.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which:

FIG. 6*e* is a degree of freedom in y-axis translation.

DETAILED DESCRIPTION

Figure 1:
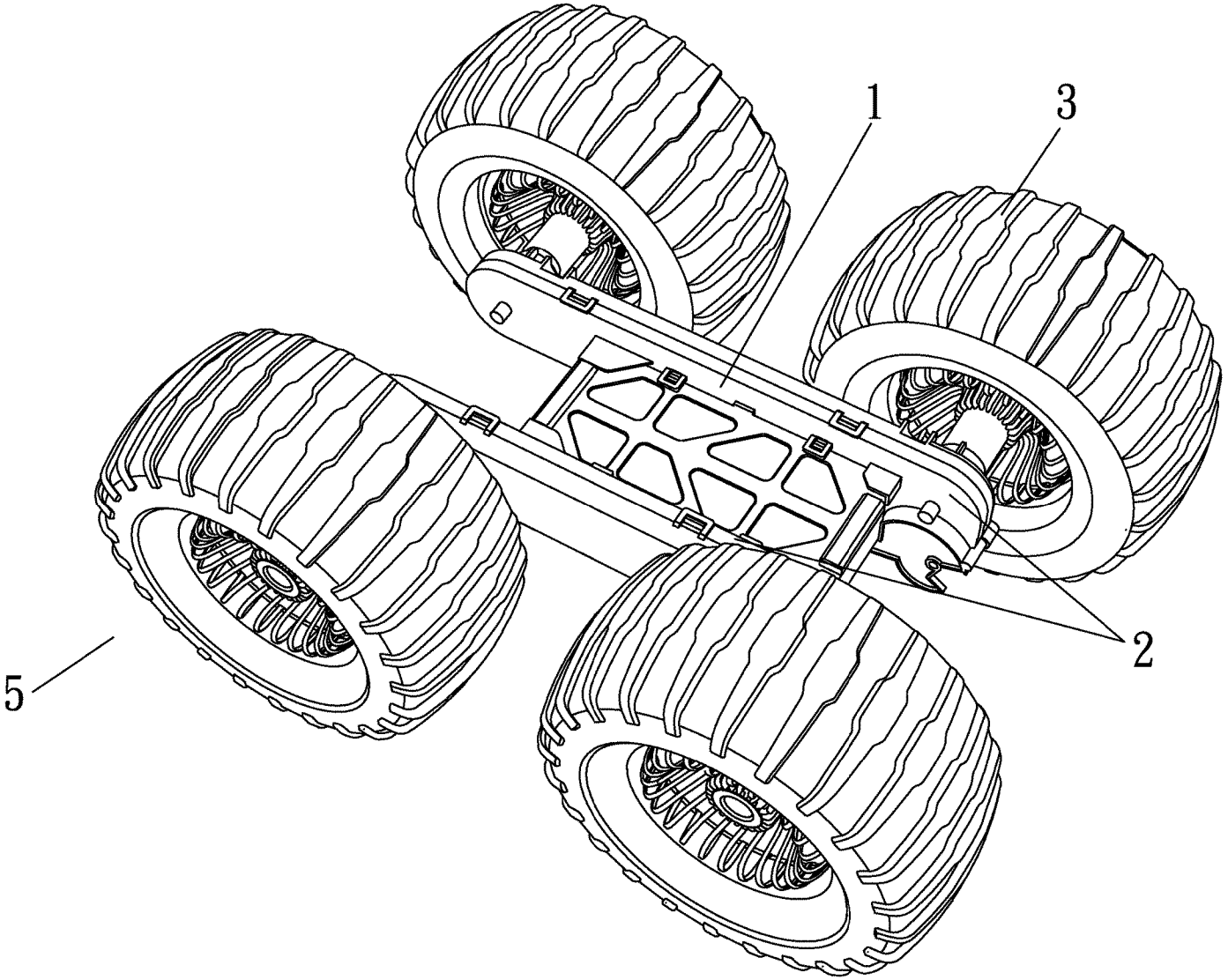
FIG. 1 is a perspective view of a car chassis.
Figure 2:
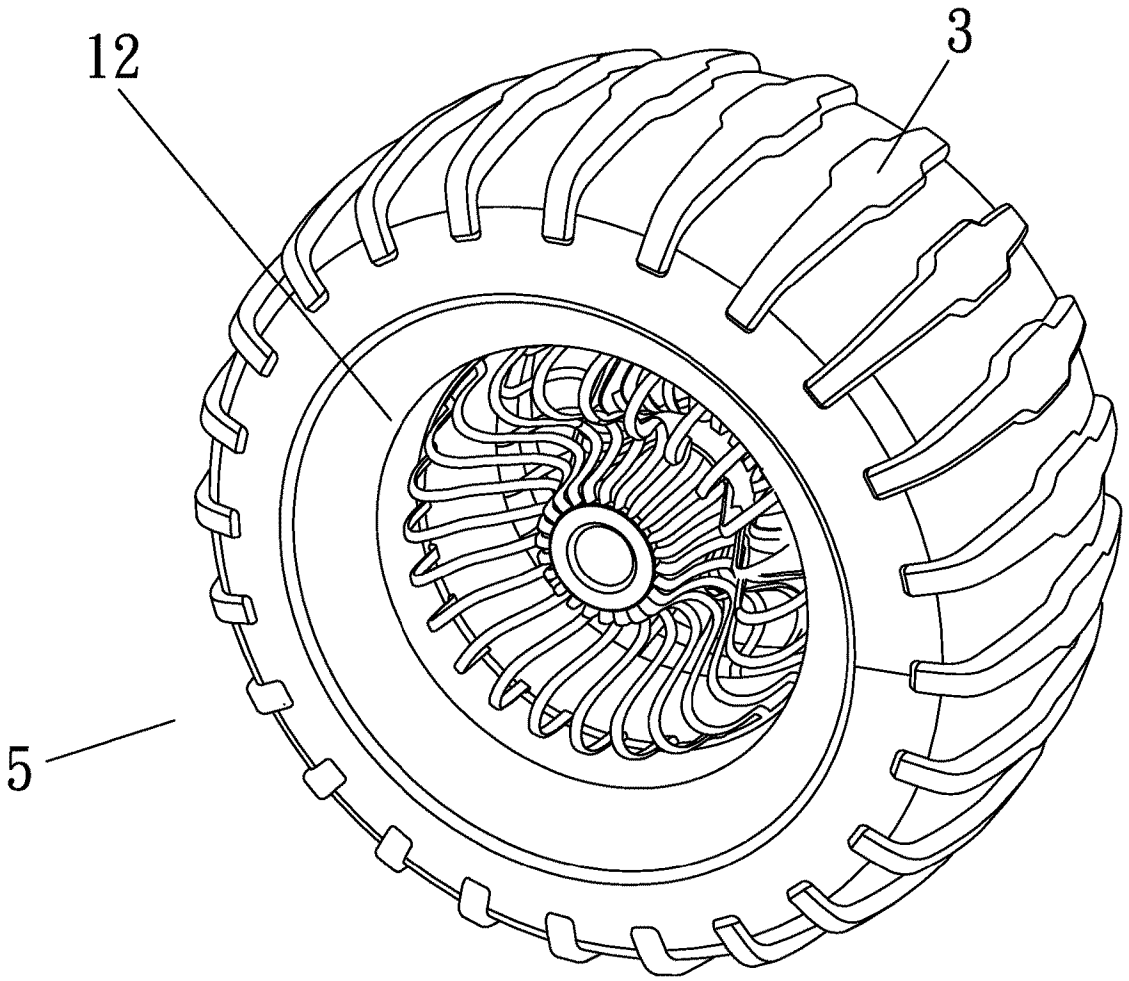
FIG. 2 is a perspective view of a wheel.
Figure 3A:
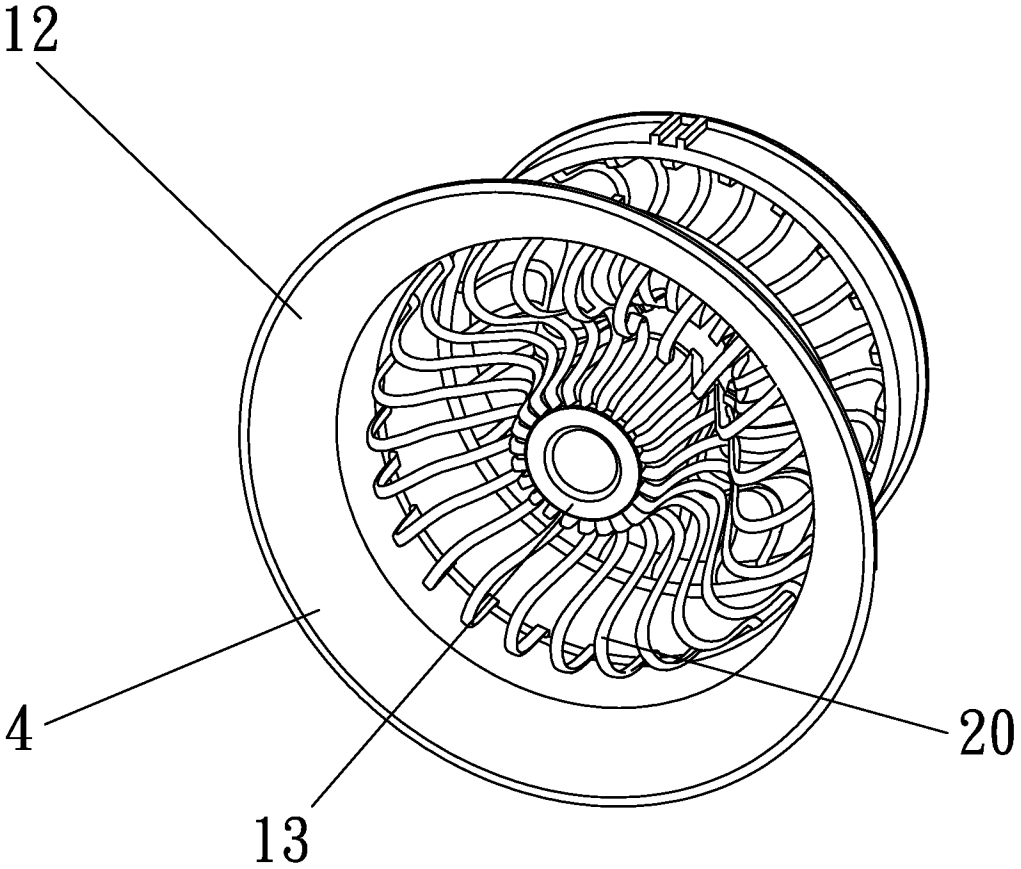
FIG. 3*a* is a perspective view of a wheel hub.
Figure 3B:
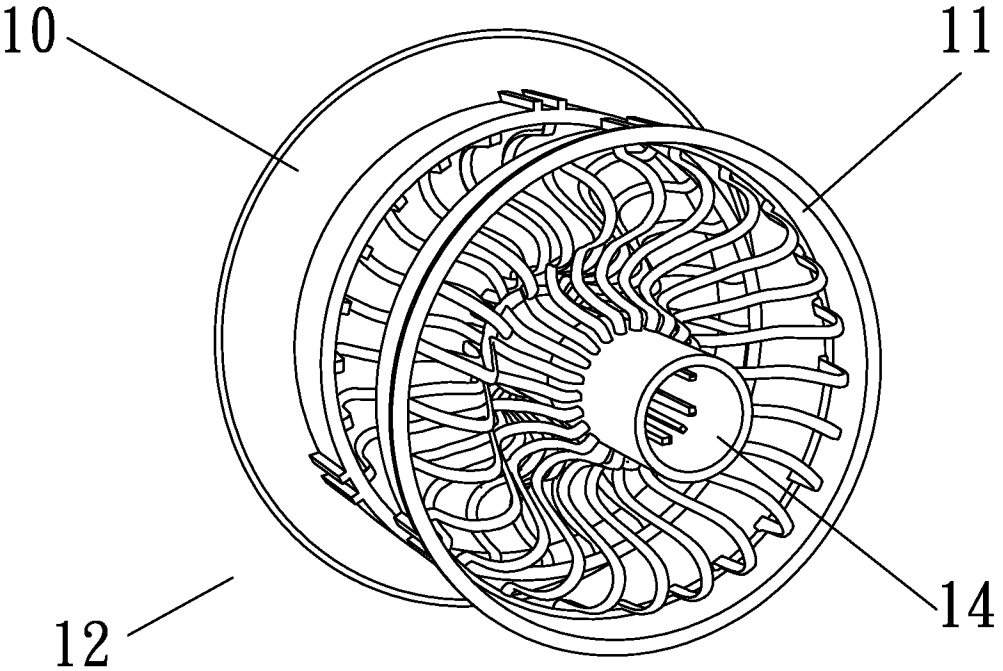
FIG. 3*b* is another perspective view of a wheel hub.
Figure 3C:
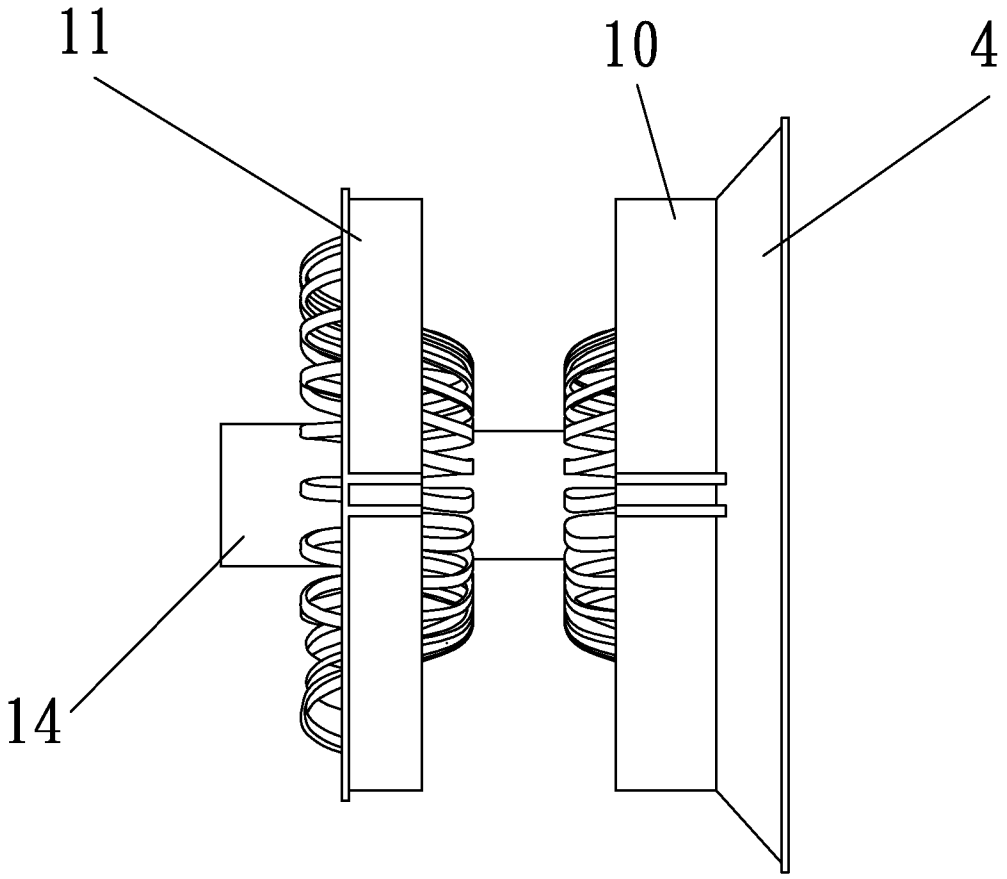
FIG. 3*c* is a side view of a wheel hub.
Figure 4A:
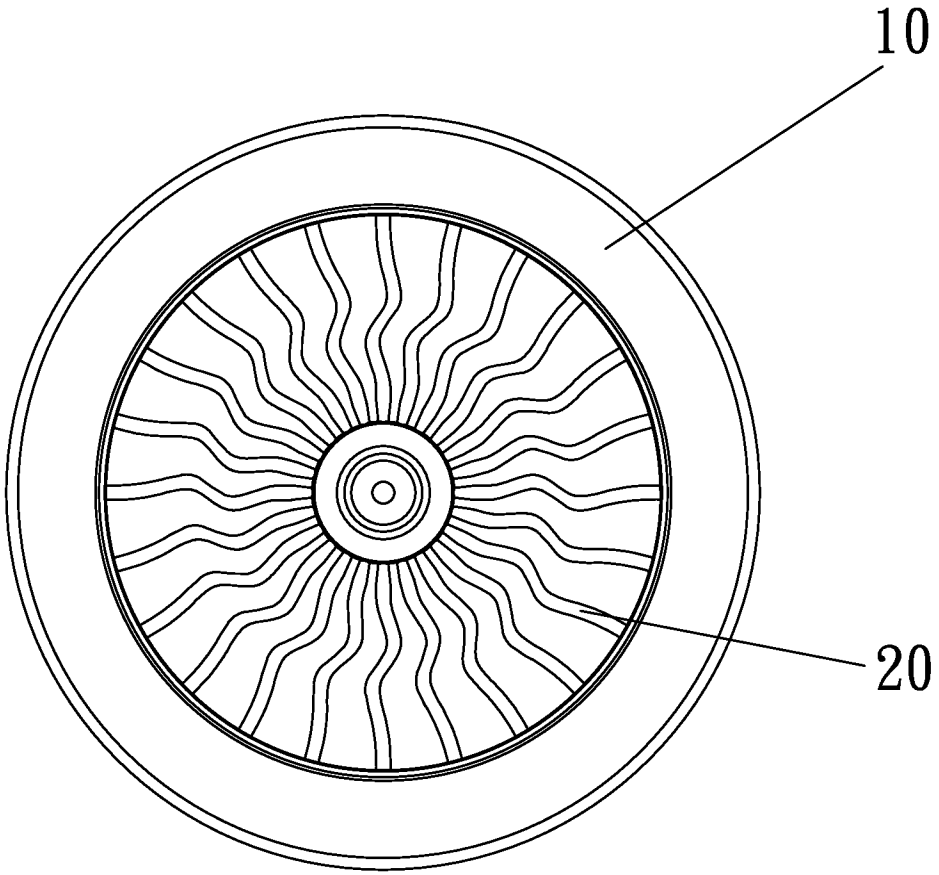
FIG. 4*a* is a front view of first part of a wheel hub.
Figure 4B:
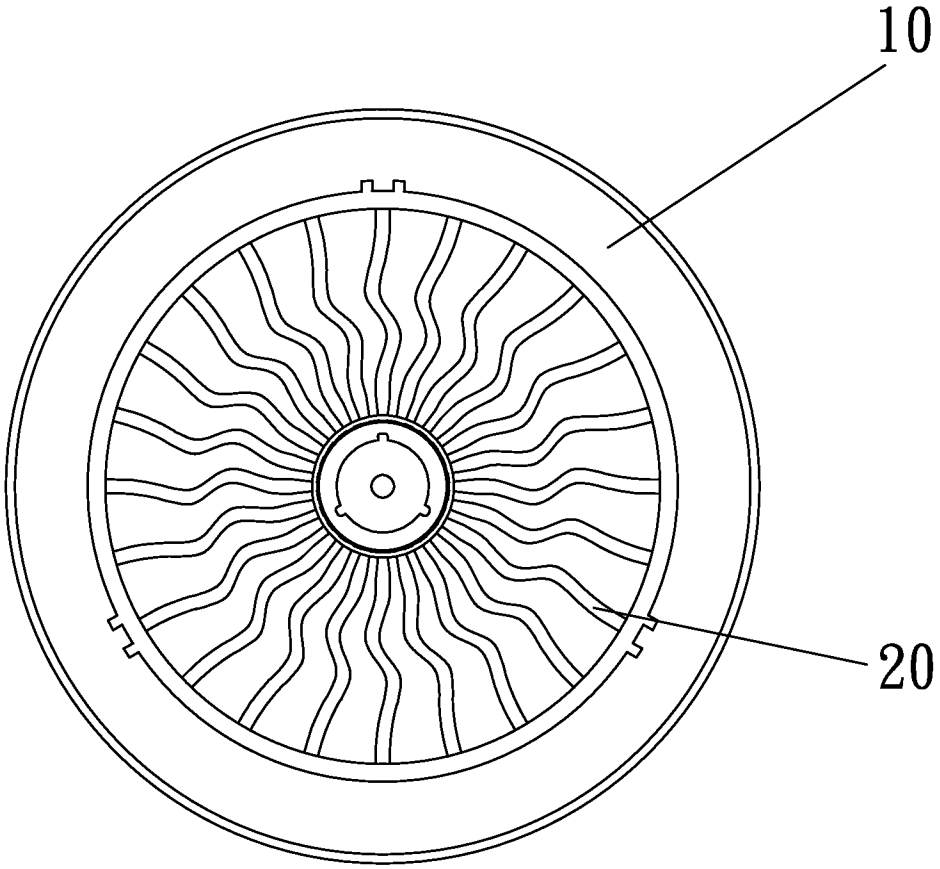
FIG. 4*b* is a rear view of first part of a wheel hub.
Figure 4C:
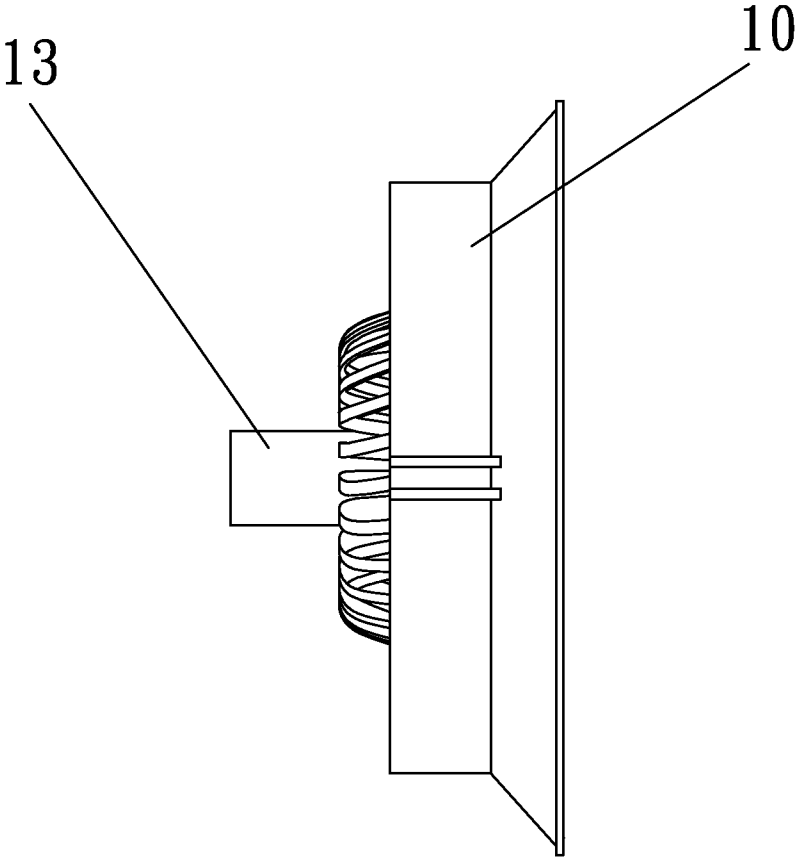
FIG. 4*c* is a side view of first part of a wheel hub.
Figure 5A:
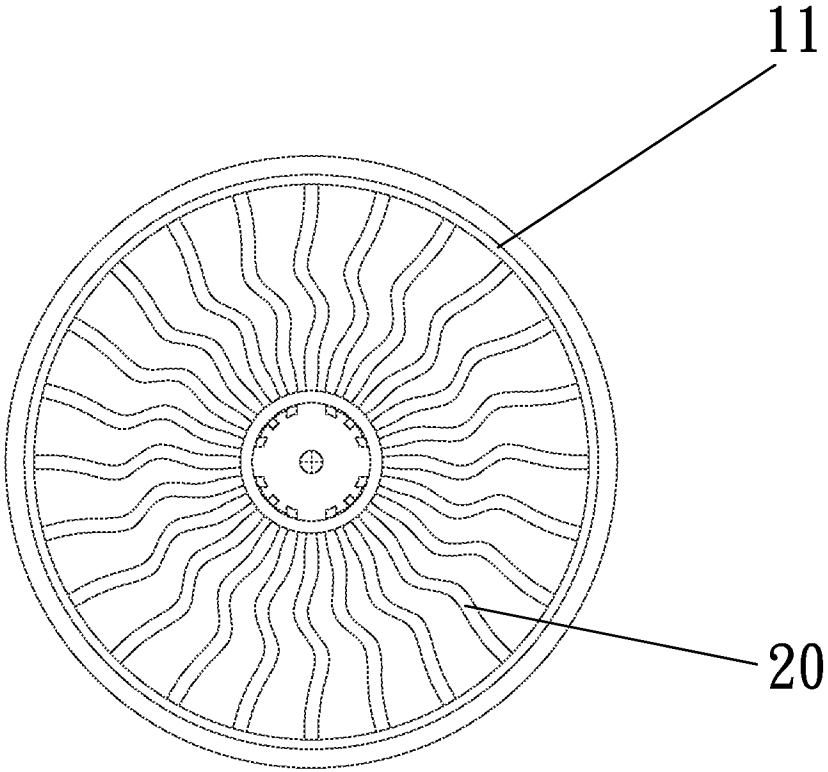
FIG. 5*a* is a front view of second part of a wheel hub.
Figure 5B:
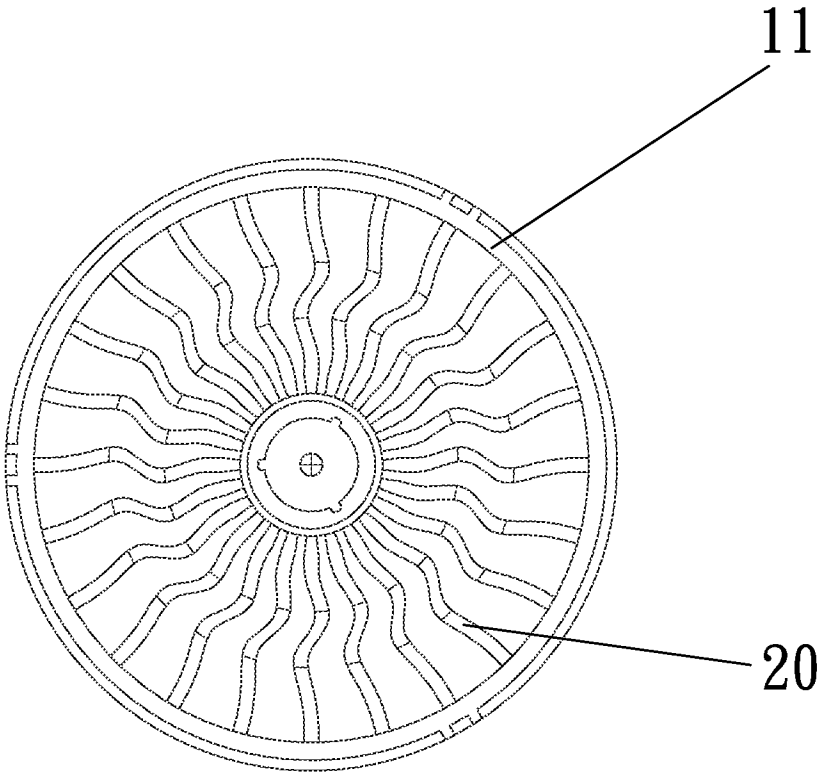
FIG. 5*b* is a rear view of second part of a wheel hub.
Figure 5C:
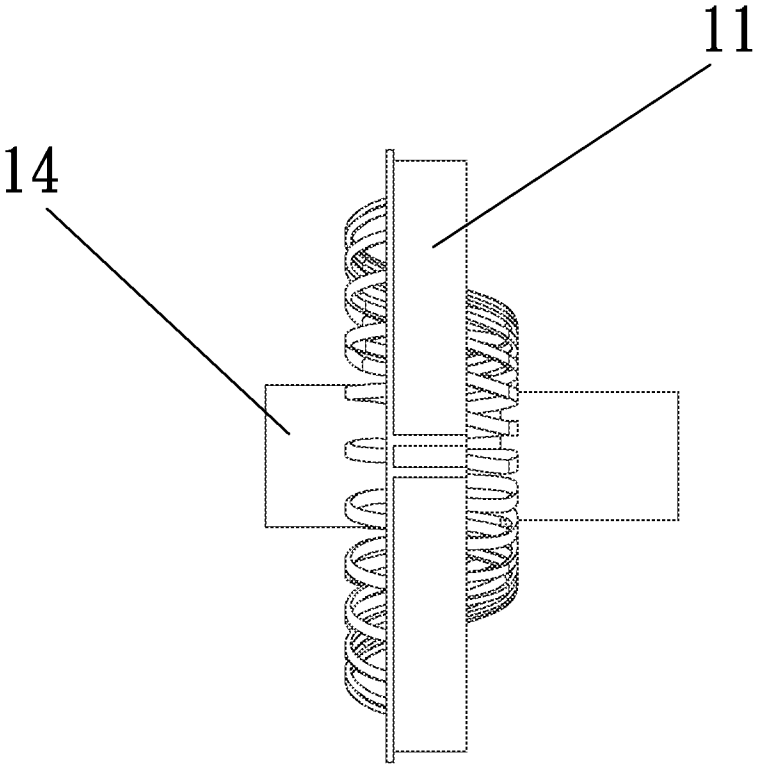
FIG. 5*c* is a side view of second part of a wheel hub.

Certain terminology is used in the following description for convenience only and is not limiting. The words "front" and "rear" designate directions in the drawings to which reference is made. The words "x axis" and "y axis" refer to directions toward and away from, respectively, the geometric center of the vehicle and designated parts thereof. The word "a" is defined to mean "at least one." The terminology includes the words above specifically mentioned, derivatives thereof and words of similar import. In the drawings, like numerals are used to indicate like elements throughout.

The disclosure includes a toy vehicle comprising a movable vehicle, the vehicle having a vehicle body with a front portion and a rear portion and a longitudinal axis extending through the front and rear portions.

At least one rear wheel coupled with the rear portion and located on the vehicle so as to at least partially support the rear portion. At least one front wheel coupled with the front portion and located on the vehicle so as to at least partially support the front portion, An electric steering motor is drivingly coupled with at least one wheel; an electrically operated steering actuator mounted for drivingly coupling at least one wheel to rotate at least one wheel to steer the toy vehicle. A driving motor rotates at least one wheel.

A wheel includes at least a set of 3-dimensional spokes act as a level of shock absorbent, providing multiple degrees of freedom including a freedom of rotation and a freedom of translation thereby to absorb kinetic energy from an impact force.

The curvature, thickness, length, material used, and the number of spokes determines the elasticity of suspension system.

Elasticity is provided along plane of rotation provides degree of freedom in pitch axis of wheel.

There are multiple wheels provided with the spokes, the wheels being free to move independently along a roll axis of the respective wheel for absorbing shock.

There are multiple wheels provided with the spokes, the wheels being free to move independently along a yaw axis of the respective wheel for absorbing shock.

There are multiple wheels provided with the spokes, a respective wheel shaft being displaceable along an x-axis for absorbing shock from longitudinal axis of vehicle.

There are multiple wheels provided with the spokes, a respective wheel shaft being displaceable along y-axis for absorbing shock from vertical axis of vehicle.

There are multiple wheels provided with the spokes, a respective wheel being displaceable independently along z-axis for absorbing shock from transverse axis of vehicle.

There can be a remote control device having controls for a user to regulate the movement of the vehicle.

The wheel of the toy vehicle comprises:

1. One or more tires made of shock absorbing, light materials such as EPP, EPS, EPE, sponge or EVA . . . etc.

2. A first part of wheel hub which includes one set of 3-dimensional, non-linear spokes and rim.
3. A second part of wheel hub includes one set of 3-dimensional, non-linear spokes and driving shaft that connects to power transmission system of vehicle.
4. The entire hub is formed by linking the shaft of first- and second-part wheel hub together Details of an exemplary embedded suspension system include:

Tire acts as the $1^{st}$ level of shock absorbent.

Two sets of 3-dimensional spokes act as the $2^{nd}$ level of shock absorbent, it provides 6 degrees of freedom consisting of three rotations and three translations to absorb kinetic energy from impact force. The 3 dimensional spoke is formed by having an S shape or curvilinear form between the ends of the spoke. The spoke shape extends outwardly and inwardly relative to the longitudinal direction of the vehicle. The one end of each spoke engages the shaft hub for the wheel and the opposite end engages the rim.

The curvatures, thickness, length, material used, and number of spokes determine the elasticity of suspension system.

Figure 6A:
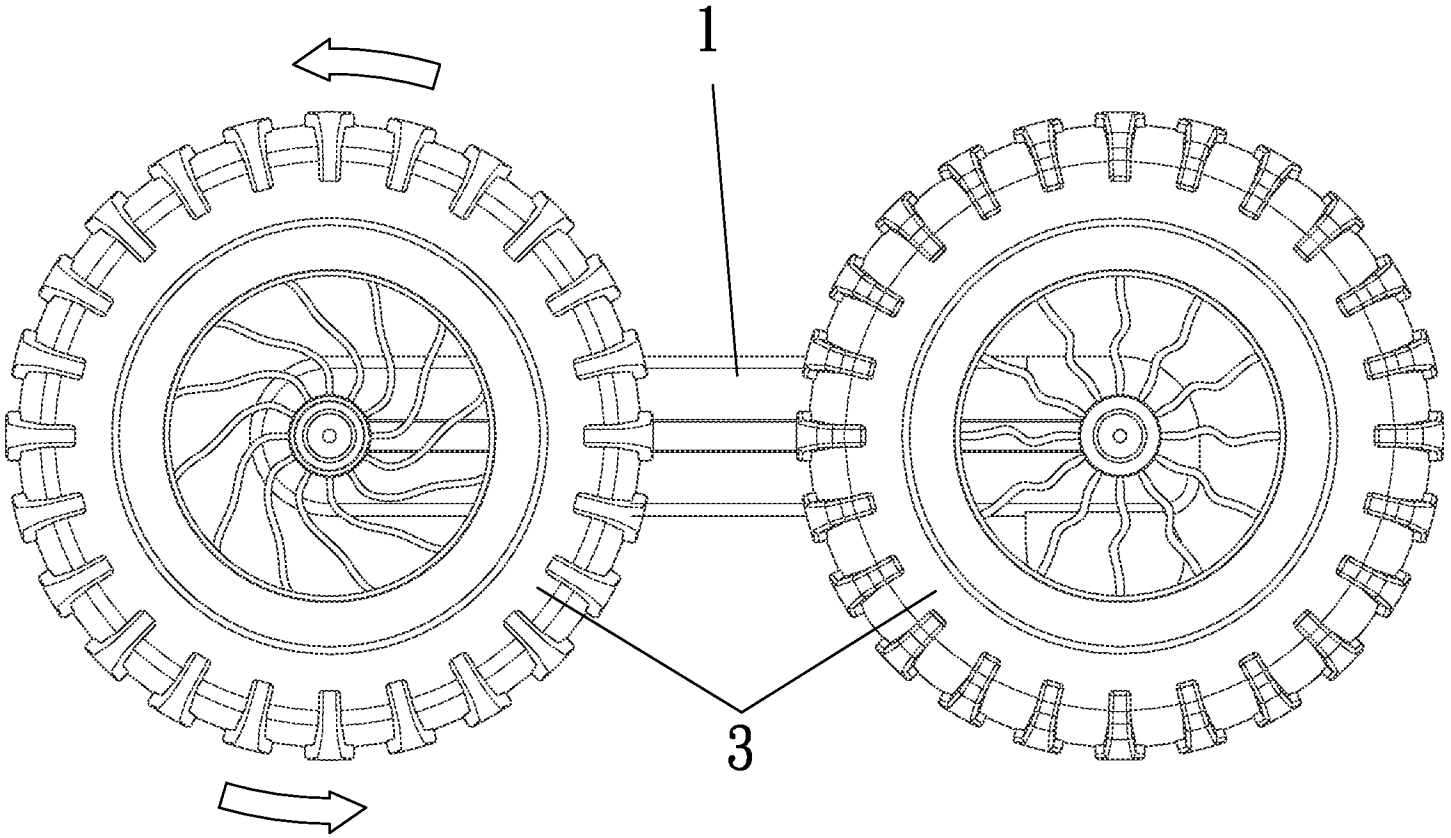
FIG. 6*a* is a degree of freedom in pitch rotation.

As shown in FIG. 6*a*, elasticity along plane of rotation provides degree of freedom in pitch axis of wheel. Comparing with rigid spokes, this elastic design has damping effect to minimize the torque required, motor stalled time while starting and hence reduce the average inrush current.

Figure 6B:
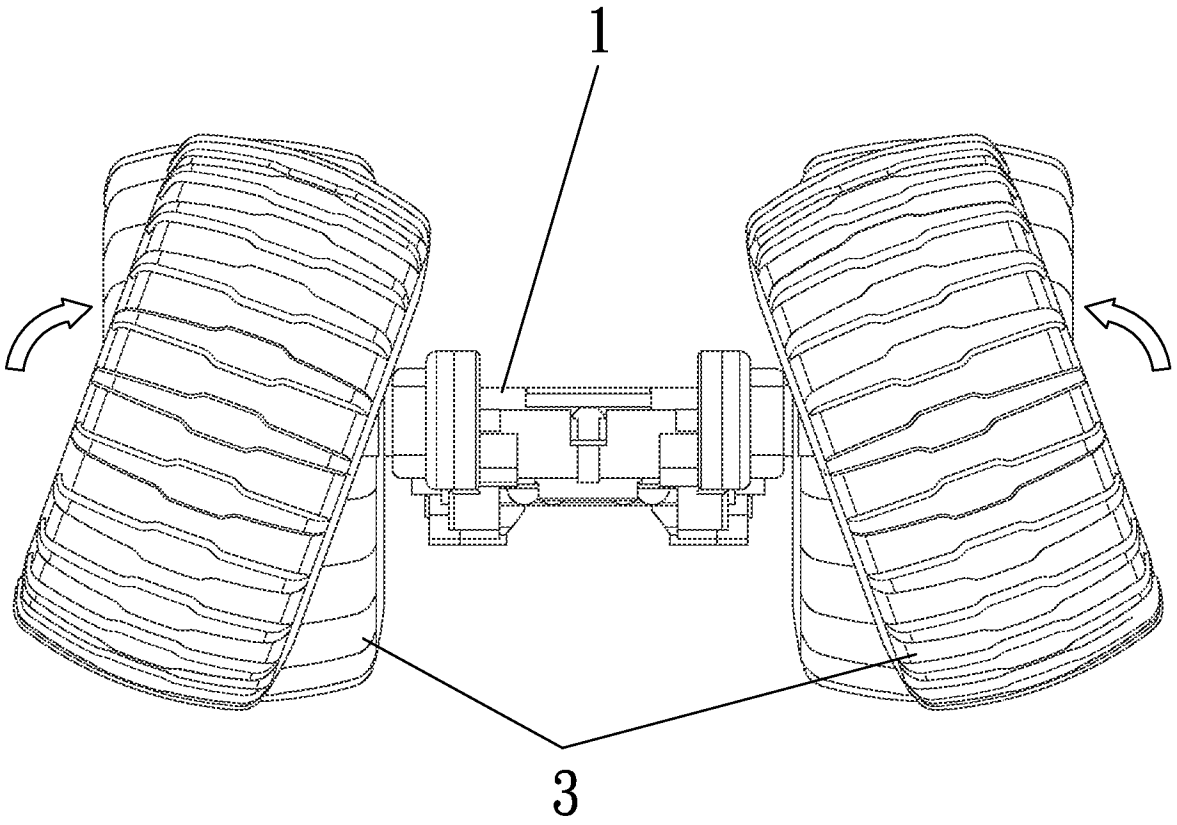
FIG. 6*b* is a degree of freedom in roll rotation.

As shown in FIG. 6*b*, two wheels are free to move independently along roll axis of wheel for absorbing shock.

Figure 6C:
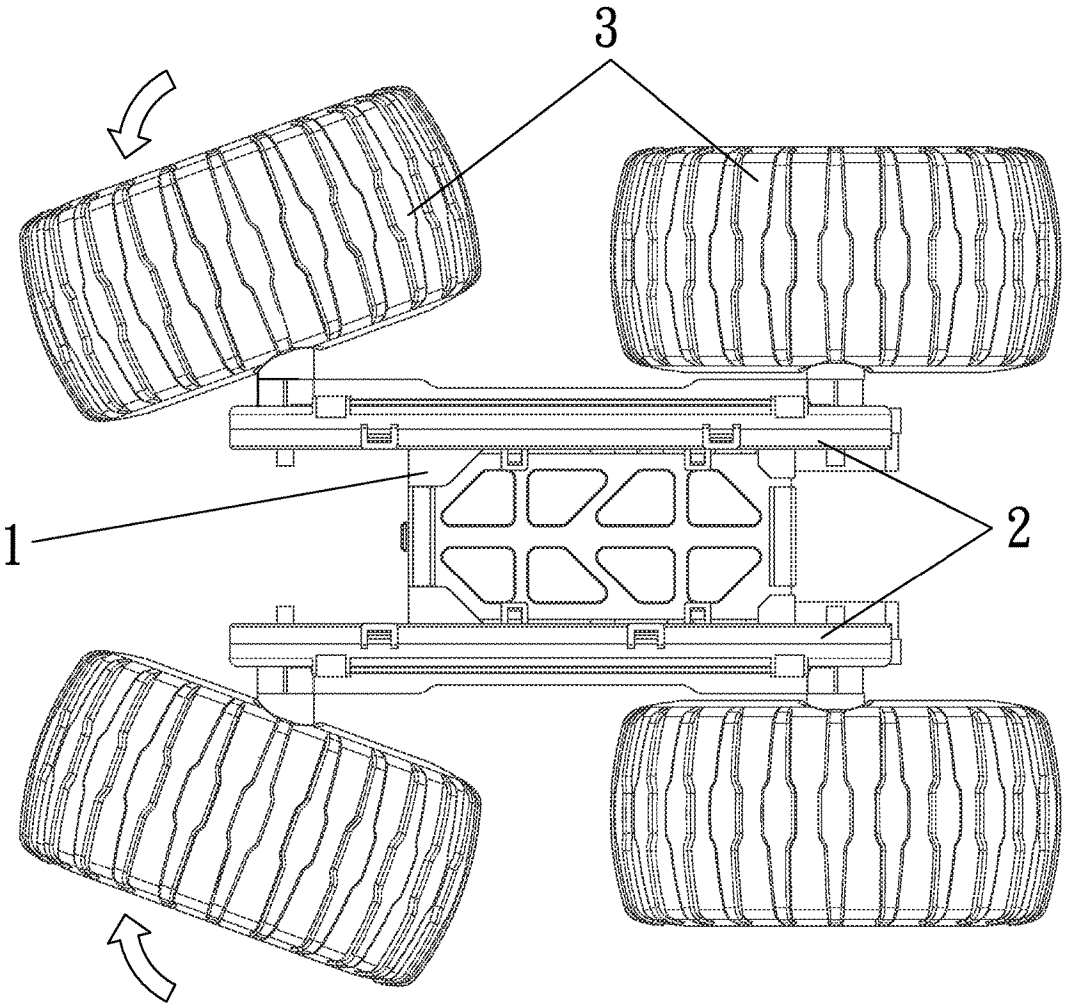
FIG. 6*c* is a degree of freedom in yaw rotation.

As shown in FIG. 6*c*, two wheels are free to move independently along yaw axis of wheel for absorbing shock.

Figure 6D:
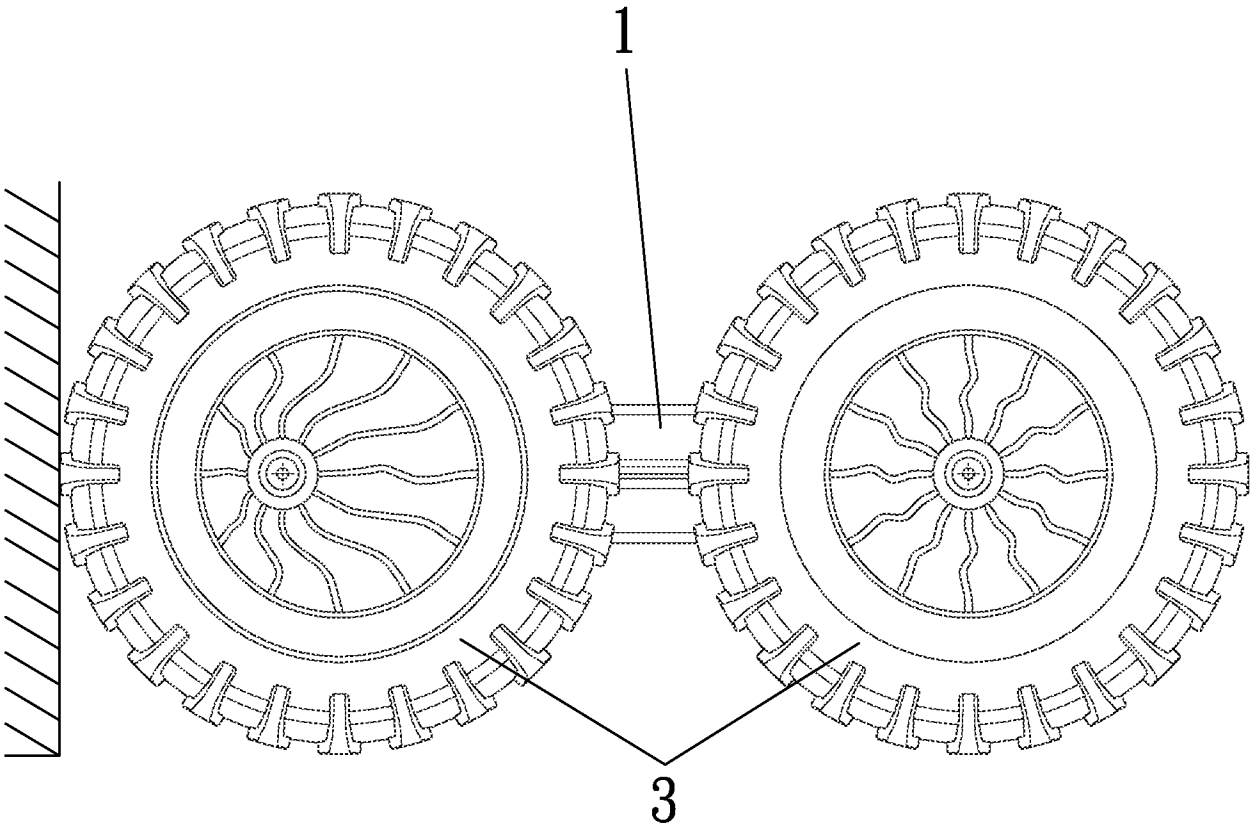
FIG. 6*d* is a degree of freedom in x-axis translation.

As shown in FIG. 6*d*, the wheel shaft can be displaced along x-axis for absorbing shock from longitudinal axis of vehicle while collision.

As shown in FIG. 6*e*, the wheel shaft can be displaced along y-axis for absorbing shock from vertical axis of vehicle while moving on rugged surface.

Figure 6F:
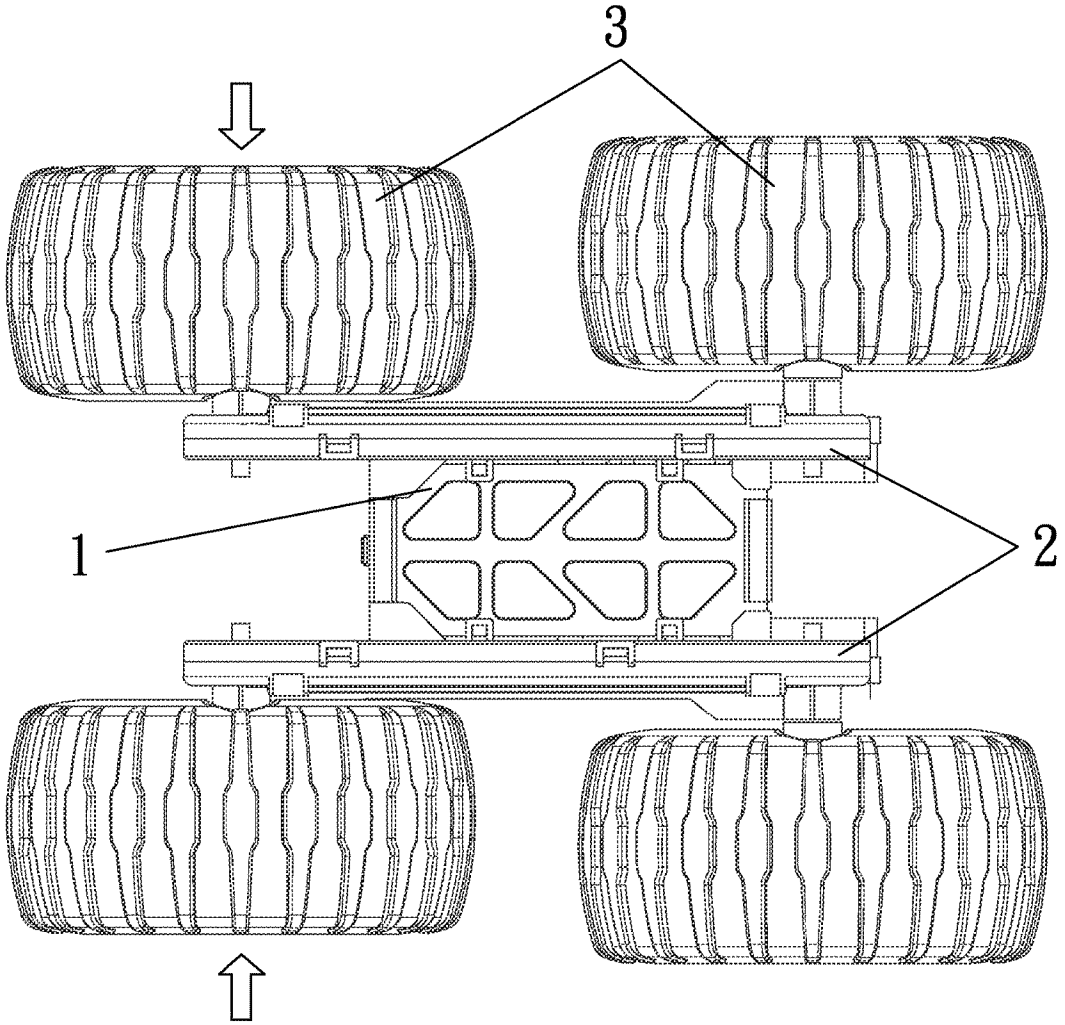
FIG. 6*f* is a degree of freedom in z-axis translation.
Figure 7:
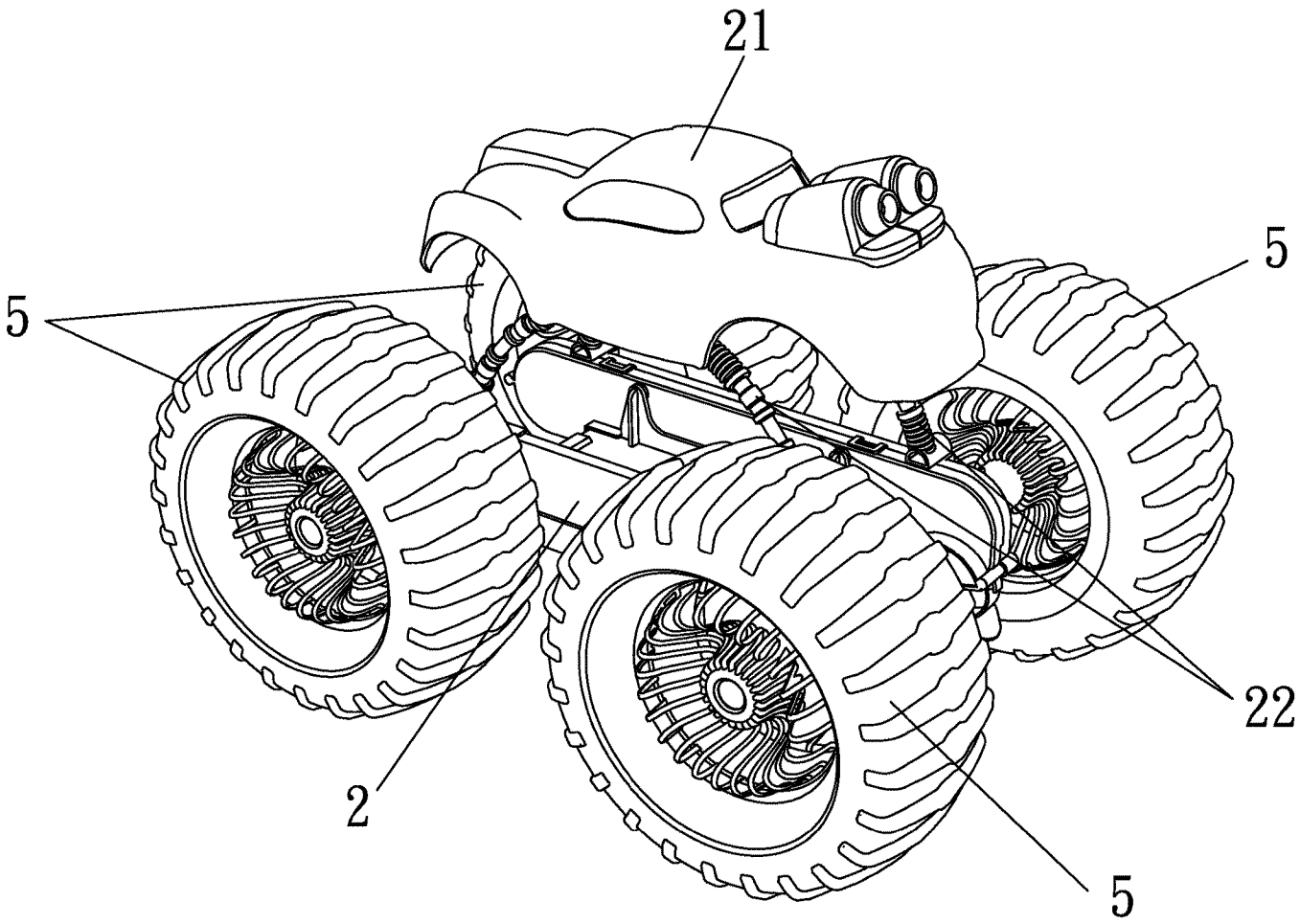
FIG. 7 is a perspective view of a 4 wheel car chassis.
Figure 8:
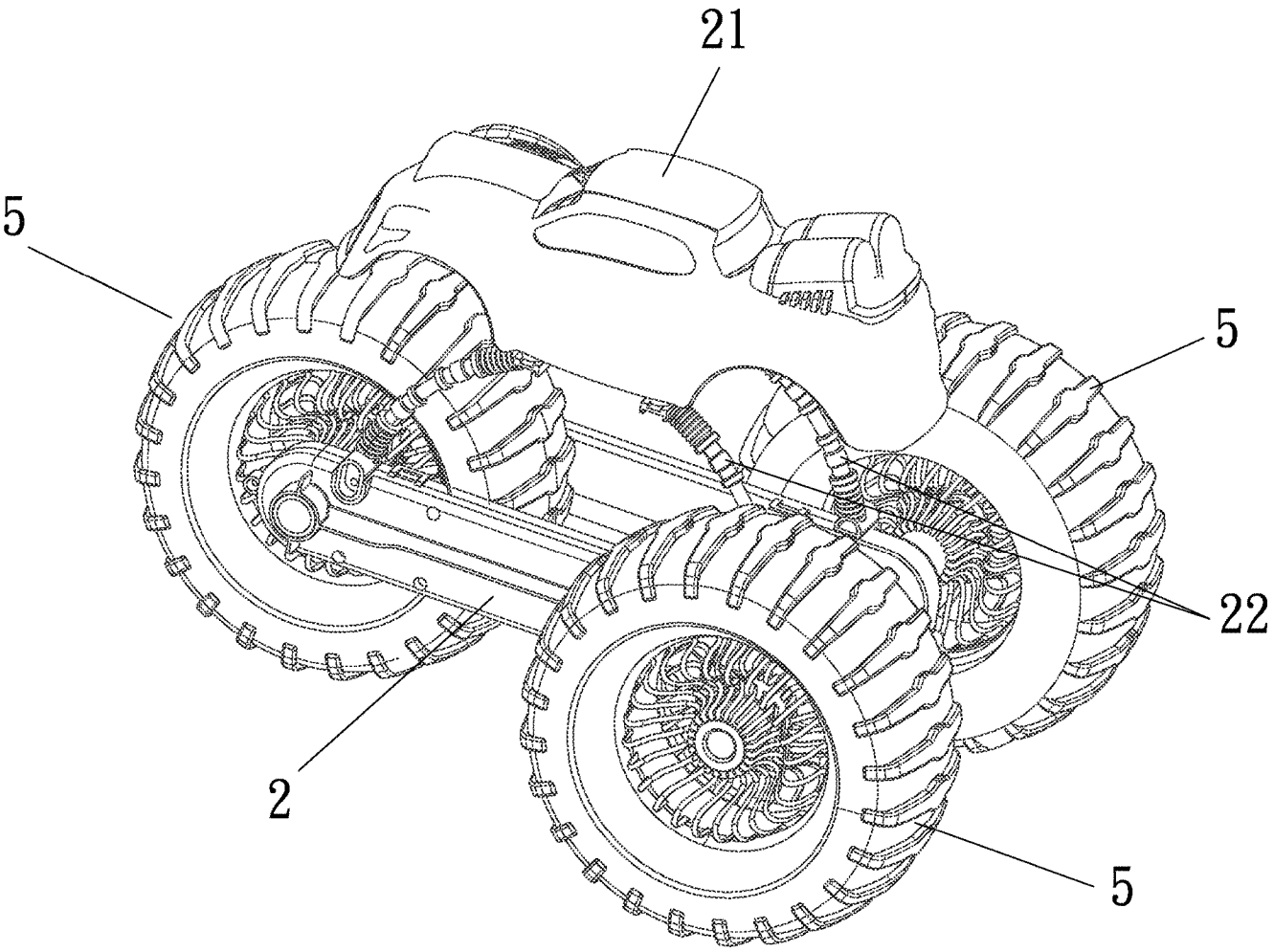
FIG. 8 is a perspective view of a 3 wheel car chassis
Figure 9:
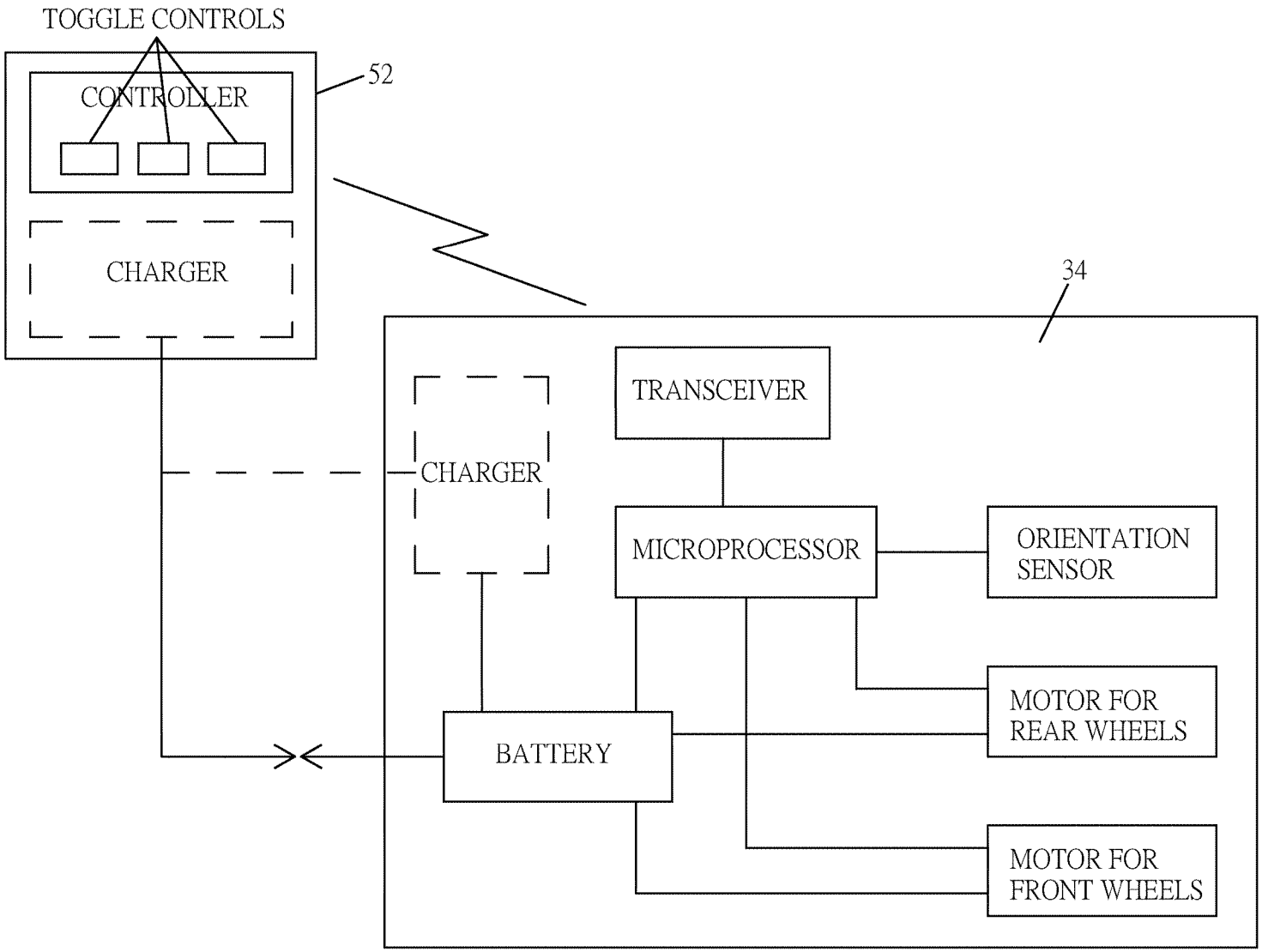
FIG. 9 shows representations of the remote controller, and electronic circuit in the vehicle with different components illustrated in block form.

As shown in FIG. 6*f*, two wheels can be displaced independently along z-axis for absorbing shock from transverse axis of vehicle.

The toy vehicle contains at least 4 wheels

A motor with corresponding left gear box is capable for providing same torque to all wheels on one side of the vehicle while another motor with corresponding right gear box is capable for providing same torque to all wheels on opposite side. Combining the suspension system on each wheel, this toy vehicle is very suitable to run on rocky or sandy terrain.

To move the vehicle straight forward or backward, wheels on left and right side maintain same speed and direction. For steering, differential speed is kept between wheels on left side and right side. By controlling the speed difference on left and right motor with microprocessor, different turning angles can be achieved. In general, no matter the chassis in different forms such as oval, rectangular hexagonal shape and wheels aligned in different angles, the steering angle could be achieved by differential speed control of wheels.

By applying external force to the wheel horizontally, the spokes can be deformed to absorb energy. It increases the time it takes the wheel to stop resulting in a lower force. Especially when wheelbase of a car is longer than car body itself, it can function as a bumper to protect the vehicle from being damaged in a collision. The wheels have a diameter such that at least the front wheels extend ahead of the chassis of the vehicle, or the rear wheels extend rearwardly behind the chassis.

This suspension system could be applied in a battery operated or a remote-control toy vehicle.

The numbering system of the drawings is set out

NUMBERING SYSTEM

Numbering system

| No. | Part Name |
|---|---|
| 1 | Chassis |
| 2 | Gear box |
| 3 | Tire |
| 4 | Rim |
| 5 | Wheel |
| 10 | First part of wheel hub |
| 11 | Second part of wheel hub |
| 12 | Wheel hub |
| 13 | Wheel shaft |
| 14 | Driving shaft |
| 20 | Spoke |
| 21 | Car body |
| 22: | Car frame |
| 34 | PCBA |
| 52 | Radio controller |

The toy car comprises a body and a chassis. The wheel diameter can be less equal to or greater than the height of car body.

This disclosure includes a remote controlled toy car, and system to enhance traction of the car on the driving surface, so that the user can control the car direction and speed with a minimum of difficulty.

According to the disclosure a toy vehicle, such as a toy car comprises a vehicle body with a front portion and a rear portion and a longitudinal axis extending through the front and rear portions. There is at least one rear wheel coupled with the rear portion and located on the vehicle so as to at least partially support the rear portion.

An electric steering motor is drivingly coupled with at least one wheel. There is at least one front wheel coupled with the front portion and located on the vehicle so as to at least partially support the front portion.

An electrically operated steering actuator is mounted for drivingly coupling at least one wheel to rotate at least one wheel to steer the toy vehicle. A driving motor rotates at least one wheel.

A toy vehicle comprising a movable vehicle and a remote control device having controls for a user to regulate the movement of the vehicle.

The car preferably includes a pair of front wheels spaced apart to either side of the vehicle body, and a preferably a pair of rear wheels spaced apart to either side of the vehicle body. There is a pair of spaced linkages arranged to either side of the longitudinal axis which is centrally located between the front and rear portions of the vehicle, and a pair of driving motors for driving the rear wheels.

Further the body can include first and second body housings, the second body housing being the chassis for the first body housing, the first body housing being the chassis for the second body housing. The extremities of the first and second housings have a height between the extremities, and the wheels have diameter greater than the height.

There is a remote control device for communicating with a transceiver located with the vehicle. The transceiver is connected with the orientation sensor and can selectively signal the orientation of the vehicle to the remote control device.

The remote control device includes one or more control levers also for regulating the rotation of the driven wheel. There can be a program for switching the direction of rotation of the driven wheel(s).

As such the vehicle can be controlled on the one hand by the microprocessor to automatically switch the rotation and steering instructions to the wheels. Additionally, the controller can regulate the direction and steering as desired.

When the remote control receives a signal from the transceiver, the wheels are rotating in the opposite direction, thereby the remote control device can retain control of the vehicle without switching the orientation of a controller on the remote control device.

When the vehicle moves, the sensor detects the change and signals a microprocessor inside the vehicle, the microprocessor responds to the signal and changes the left/right motor control signal to the steering motor and the forward/backward motor control signal on the driving motor.

The wheels are formed of low density material, such as a foam material.

The toy is a combination with a remote control device configured to selectively control movement of the toy vehicle and activation of the rotational drive mechanism.

The remote control device comprises a handheld remote controller having a multi-part housing, and wherein at least two of the housing parts are pivotable with respect to each other in order to control an operation of the toy vehicle.

The twin-body toy car is based on the following design so as to achieve user-friendly control, good controllability and high speed.

In order to obtain high speed, the car should be light. There is a relatively powerful motor to drive at least one of the rear wheels, the wheels are made of sponge, the car body is made of light plastic material such as polypropylene or more high energy density LiPo batteries are chosen. There are miniature coreless motors used for driving the front and rear wheels as needed.

The control system is preferably a 2.4 GHz frequency which is chosen because of the compact electronics and also built-in antenna on the PCB.

There is a symmetric suspension system on the chassis to withstand the shock or force exerting on either car housings when the vehicle crashes, flips and/or jumps.

There is a (1) Battery power source such as LiPo, LiFePO4 or Li-ion.

(2) PCBA for electronic microprocessor system control and a radio transceiver in 2.4 GHz for 2-way communication.

A vehicle includes (1) A driving mechanism associated with one or two dc motor(s) and gearbox(es).

(2) 2 sponge wheels which in the alternative may be other low density materials such as EPP, foam or EVA etc.

There is a radio controller which is remotely located relative to the car and is used by the user to control speed and direction with different toggle controls and on the face of the controller. There can be a charger unit associated with the controller, and the charger is connectable through a cable for recharging the battery. In an alternative way, the charger unit can be located inside the car, the primary battery is connected to the charger unit through a cable.

The body can have different forms and can include a hood and fenders mounted to the top housing. The steering assembly is mounted with the body, and the front supports a front bumper and at least one and preferably two front wheel assemblies. The front body can further include a first battery, and if desired a second battery.

The front wheel assemblies each include a wheel hub and a tire. The hub is attached to a support arm. The support arms can include a top support pin and a bottom support pin. The support arms further include a steering pivot pin.

The steering assembly is coupled to the wheel assemblies to provide powered steering control. The steering assembly is preferably a conventional design that includes a motor, a slip clutch and a steering gear box, all of which can be contained within motor and gear box housing. A steering actuating lever can extend from the motor and gear box housing and moves from left to right. The steering actuating lever can fit within a receptacle in a tie rod. The tie rod is provided with holes at each opposing end. The steering pivot pins fit within the holes. As the tie rod moves left and right under the action of the steering actuating lever the front wheel assemblies are caused to turn as support arms are pivoted by steering pivot pins. The position of the tie rod can be adjustable by a steering trim mechanism. One of ordinary skill will appreciate that any know steering assembly can be used with the present disclosure to provide steering control of the toy vehicle.

The rear chassis can include a second top housing and a second bottom housing. The housings can be ornamented cover assemblies.

The rear chassis mounts a drive assembly, one or more rear wheel assemblies mounted to an axle, and mounted for rotation relative to the housing. The housing can include a drive shaft aft support member, a drive shaft forward support member, a spring support member.

A circuit board containing the device electronics is supported by a mounting with the front body. The circuit board is electrically connected with the front and rear motors. An on/off switch is accessible from the underside of the bottom housing.

The antenna is preferably coupled within or to circuit board and is capable of receiving and/or transmitting signals between a remote controller and the circuit board to control operation of the toy vehicle.

The drive assembly includes one or two drive motors. The drive motors can be reversible electric motors of the type generally used in toy vehicles. The motors are operably coupled to the axle through a drive gear train. The drive gear train includes a pinion affixed to an output shaft of the drive motors. The pinion engages a combined reduction gear with other gears fixedly attached to the axle. The motors can thus drive the rear wheel assemblies through the drive gear train in either a forward or reverse direction. Other drive train arrangements could be used such as belts or other forms of power transmission. The arrangements disclosed herein are not meant to be limiting.

In operation, a user drives the toy vehicle so that irrespective of the vehicle can continue driving in the selected forward or reverse direction.

The vehicle can be constructed of, for example, plastic or any other suitable material such as metal or composite materials. From this disclosure, it would be obvious to one skilled in the art to vary the dimensions of the toy vehicle shown, for example making components of the toy vehicle smaller or larger relative to the other components. The toy vehicle is preferably controlled via radio (wireless) signals from a remote controller. However, other types of controllers may be used including wired controllers, voice-activated controllers, and the like.

A preferred embodiment of a remote controller for use with the present disclosure preferably comprises a multi-part housing having left hand and right hand toggles. Each of the left hand and right hand toggles are on a top housing. An antenna may be included to receive and/or transmit signals to and/or from the remote controller.

The remote controller also preferably includes circuitry to, for example, process inputs from the switch, the left and right toggles, switches, and to transmit and receive signals to and from the toy vehicle.

It will be understood that the remote controller can be formed of a variety material and may be modified to include additional switches and/or buttons. It will be further understood that a variety of other types of controllers may be used to control the operation of the toy vehicle of the present disclosure.

One of ordinary skill will appreciate that although the embodiments discussed above refer to a single orientation sensor, there could be more than one sensor with the toy vehicle and other modes of operation could be used depending on orientation. For example, the one or more sensors could be actuated upon driving the vehicle in a forward direction, or by activating a switch on a remote controller.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure.

Many of the features of the present disclosure are implemented by suitable algorithms that are executed by one or more the microprocessors with the vehicle and/or remote controller. For example, all voltages and, currents at critical circuit points, and velocity are monitored by the software routines.

Although the present disclosure has been described with respect to particular embodiments thereof, variations are possible. Although the disclosure is described of a four-wheeled embodiment, the present disclosure there could also comprise a vehicle having three wheels, or more than four wheels or a track drive system. There may be a motorcycle format with 2 wheels, or a system with 3 wheels, for instance two in the rear and one in the front. The microprocessor for changing direction and turning of the wheels may be located in the remote controller device rather than the vehicle.

The present disclosure may be embodied in specific forms without departing from the essential spirit or attributes thereof. In particular, although the disclosure is illustrated using a particular format with particular component values, one skilled in the art will recognize that various values and schematics will fall within the scope of the disclosure. It is desired that the embodiments described herein be considered in all respects illustrative and not restrictive and that reference be made to the appended claims and their equivalents for determining the scope of the disclosure.

The invention claimed is:

1. A toy vehicle having a vehicle body with a front portion and a rear portion and a longitudinal axis extending through the front and rear portions; at least one rear wheel coupled with the rear portion and located on the vehicle so as to at least partially support the rear portion; at least one front wheel coupled with the front portion and located on the vehicle so as to at least partially support the front portion, wherein each of the at least one rear wheel and each of the at least one front wheel includes a flexible tire supported on a wheel hub assembly, the wheel hub assembly comprising:

a first hub part and a second hub part coupled together, the first hub part having an outer rim concentrically spaced from a tubular wheel shaft by a first plurality of three-dimensional S shaped spokes spaced around and extending between the outer rim and the tubular wheel shaft;

the second hub part having an inner rim concentrically spaced from a tubular driven shaft by a second plurality of three-dimensional S shaped spokes spaced around and extending between the inner rim and the concentrically spaced tubular driven shaft; wherein first and second pluralities of three-dimensional spokes act as a shock absorber, providing multiple degrees of freedom including a freedom of rotation and a freedom of translation thereby to absorb kinetic energy from an impact force.

2. The toy vehicle according to claim 1 wherein the at least one front wheel is a pair of front wheels spaced apart to either side of the vehicle body, the at least one rear wheel is a pair of rear wheels spaced apart to either side of the vehicle body, wherein the wheels have an outer diameter such that the pair of front wheels extend ahead of the vehicle or the rear wheels extend rearwardly behind the vehicle body, and the tires of the wheels include a low density material.

3. The toy vehicle according to claim 1 wherein the tubular driven shaft is coupled to the tubular wheel shaft such that the shafts may axially move relative to each other.

4. The toy vehicle according to claim 1 further comprising the outer rim of the first hub part having a larger diameter than the inner rim of the second hub part.

5. The toy vehicle according to claim 1 wherein the outer rim has a conical surface portion.

6. The vehicle according to claim 1 wherein each of the plurality of three-dimensional S shaped spokes of the first hub part curves first inward from the tubular wheel shaft toward the second hub part.

7. The toy vehicle according to claim 1 wherein each of the three-dimensional S shaped spokes of the second hub part curves first inward from the tubular driven shaft toward the first hub part.

8. The toy vehicle according to claim 7 wherein each of the plurality of three-dimensional S shaped spokes of the second hub part curves outward beyond the inner rim and then back toward the inner rim.

9. The toy vehicle according to claim 1 wherein each of the plurality of three-dimensional S shaped spokes of the first hub part and the second hub part each first curves inward from its shaft toward an other of the first and the second hub parts.

10. The toy vehicle according to claim 1 wherein the outer rim of the first hub part and the inner rim of the second hub part each has a straight tubular portion.

11. The toy vehicle according to claim 10 wherein the outer rim of the first hub part has a conical tubular portion.

12. The toy vehicle according to claim 10 wherein each of the plurality of three-dimensional S shaped spokes of the first hub part curves outward beyond the straight tubular portion of the outer rim of the first hub part and then back toward the straight tubular portion of the outer rim of the first hub part.

13. A toy vehicle having a vehicle body with a front portion and a rear portion and a longitudinal axis extending through the front and rear portions; at least one rear wheel coupled with the rear portion and located on the vehicle so as to at least partially support the rear portion, at least one front wheel coupled with the front portion and located on the vehicle so as to at least partially support the front portion, wherein each of the at least one rear wheel and each of the at least one front wheel includes a flexible tire supported on a wheel hub assembly, the wheel hub assembly comprising:

a first hub part and a second hub part axially coupled together, the first hub part having an outer rim concentrically spaced from a tubular wheel shaft by a first plurality of three-dimensional S shaped spokes spaced around and extending between the outer rim and the tubular wheel shaft;

the second hub part having an inner rim concentrically spaced from a tubular driven shaft by a second plurality of three-dimensional S shaped spokes spaced around and extending between the inner rim and the concentrically spaced tubular driven shaft; wherein each of the first and second pluralities of three-dimensional spokes acts as a shock absorber, providing multiple degrees of freedom including a freedom of rotation and a freedom of translation thereby to absorb kinetic energy from an impact force.

14. The toy vehicle according to claim 13 wherein the tubular driven shaft is coupled to the tubular wheel shaft such that the shafts may axially move relative to each other.

15. The toy vehicle according to claim 13 further comprising the outer rim of the first hub part having a larger diameter than the inner rim of the second hub part.

16. The toy vehicle according to claim 13 wherein the outer rim has a conical surface.

17. The vehicle according to claim 13 wherein each of the plurality of three-dimensional S shaped spokes of the first hub part curves first inward from the tubular wheel shaft toward the second hub part.

18. The toy vehicle according to claim 13 wherein each of the plurality of three-dimensional S shaped spokes of the second hub part curves first inward from the tubular driven shaft toward the first hub part.

19. The toy vehicle according to claim 13 wherein each of the plurality of three-dimensional S shaped spokes of the first hub part and the second hub part each first curves inward from its shaft toward an other of the first and the second hub parts.

20. The toy vehicle according to claim 13 wherein the outer rim of the first hub part and the inner rim of the second hub part each has a straight tubular portion.

* * * * *